US005109647A

United States Patent [19]

La See

[11] Patent Number: 5,109,647

[45] Date of Patent: * May 5, 1992

[54] GRILL CLIP

[76] Inventor: Jack C. La See, 308 W. Cedar, Abbotsford, Wis. 54405

[ * ] Notice: The portion of the term of this patent subsequent to Aug. 8, 2006 has been disclaimed.

[21] Appl. No.: 555,982

[22] Filed: Jul. 20, 1990

[51] Int. Cl.[5] ..... E04B 1/61

[52] U.S. Cl. ..... 52/773; 52/456; 52/507

[58] Field of Search ..... 52/769, 773, 507, 455, 52/456, 311, 314

[56] References Cited

U.S. PATENT DOCUMENTS

| | | | |
|---|---|---|---|
| 790,908 | 5/1905 | Mills | 52/774 |
| 1,073,805 | 9/1913 | Kinnear | 52/774 |
| 1,946,716 | 2/1934 | Smidt | 52/774 |
| 2,714,432 | 8/1955 | Blanchard | 52/774 |
| 2,901,786 | 9/1959 | Batts | 52/773 |
| 4,854,100 | 8/1989 | La See | 49/57 |

*Primary Examiner*—David A. Scherbel
*Assistant Examiner*—Kien Nguyen

[57] ABSTRACT

A concealed grill clip is used to secure a conventional grill to a window or door frame. The grill includes a plurality of grill bars secured to each other in right angular relation, each bar having a recess in each end thereof. A plurality of grill clips secure each grill to a frame. Each clip includes a frame engaging leg and a coupling leg. The frame engaging leg of each clip is secured to the window frame. The coupling leg of one embodiment presents an outwardly convex outer surface which engages in an angular recess in a grill bar with spring coupling effect. In another embodiment the coupling leg includes a rolled portion which engages in a arcuate recess in the grill bar with spring coupling action.

7 Claims, 2 Drawing Sheets

GRILL CLIP

FIELD OF INVENTION

This invention relates to a novel clip for use in securing a conventional grill to a window or door frame.

BACKGROUND OF THE INVENTION

In my U.S. Pat. No. 4,854,100 I have disclosed a concealed spring clip for securing an ornamental grill to a window or door frame. The spring effect of the clip allows it to positively retain the grill in mounted relation on the window or door frame. The present invention is directed to an improved concealed grill clip.

SUMMARY OF THE INVENTION

It is an object of this invention to provide a novel and improved concealed grill clip for securing a grill to a window or door frame. The concealed grill clip utilizes resilient spring action to engage and secure the grill to the window or door frame.

In one embodiment of the invention, the grill clip is of generally L-shaped configuration including a flat frame engaging leg for engaging the window or door frame, and a coupling leg having a rolled edge portion that engages in a recess in the grill with snap coupling effect to secure the grill to the window or door frame.

In another embodiment, the concealed grill clip is also of generally L-shaped configuration and includes a frame engaging leg for engaging the window or door frame, and a coupling leg of outwardly convex angular configuration which engages a recess in the grill with the same snap coupling effect.

FIGURES OF THE DRAWING

PREFERRED EMBODIMENT OF THE INVENTION

Figure 1:
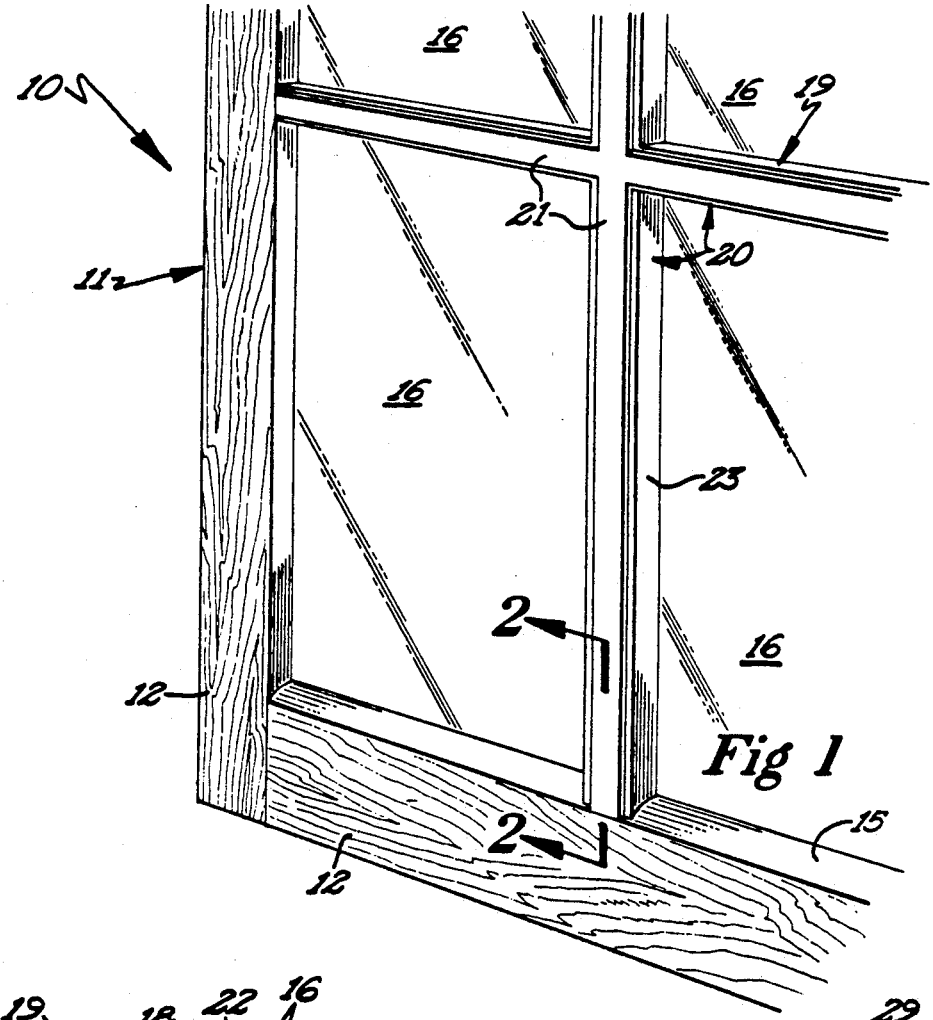
FIG. 1 is a perspective view of a conventional window having a grill secured thereto by one embodiment of my novel and improved grill clip.

Referring now to FIGS. 1-4, it will be seen that one embodiment of the novel concealed grill clip is employed for securing an ornamental grill to a conventional window 10. The window 10 includes a generally rectangular shaped frame 11 comprised of frame members 12 secured to each other in right angular relationship. The window frame members 12 are recessed to define a flat surface 13 disposed at right angle relationship to a flat surface 14. Transparent spaced apart panes 16 engages flat surface 13 of each frame members 12, and one of the panes is positioned against the flat surface

14 of each frame member. The frame members 12 of the window frame 11 are also each provided with a convex surface portion 15 which faces inwardly and is located on the inner surface of the window 10.

A suitable glazing compound 17 sealingly secures the glass panes 16 to the frame members 12. The glazing compound is applied to the peripheral edge portions of the pane to form a seal with the frame members. The innermost pane 16 is provided with a flat inner surface 18 which faces inwardly of the window 10.

An ornamental grill 19 is secured to the window 10 and engages the inner surface 18 of the innermost pane 16. Grill 19 is comprised of a plurality of interconnected horizontal and vertical grill bars 20. Each bar 20 includes an outer surface 21, a flat inner surface 22 and side surfaces 23. When the grill 19 is applied to a window, the grill 19 will be positioned against the inner surface of the window so that the inner flat surface 22 of each grill bar 20 engages the inner surfaces 18 of the innermost pane 16.

Figure 4:
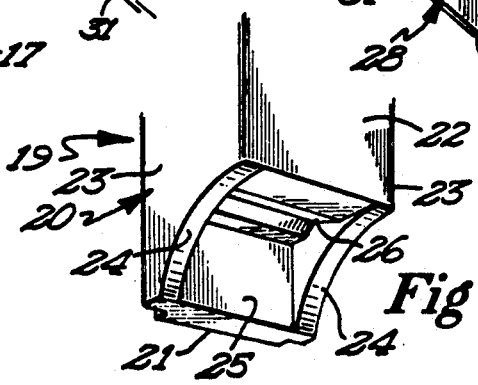
FIG. 4 is a fragmentary perspective view of the end portion of a grill bar.
Figure 5:
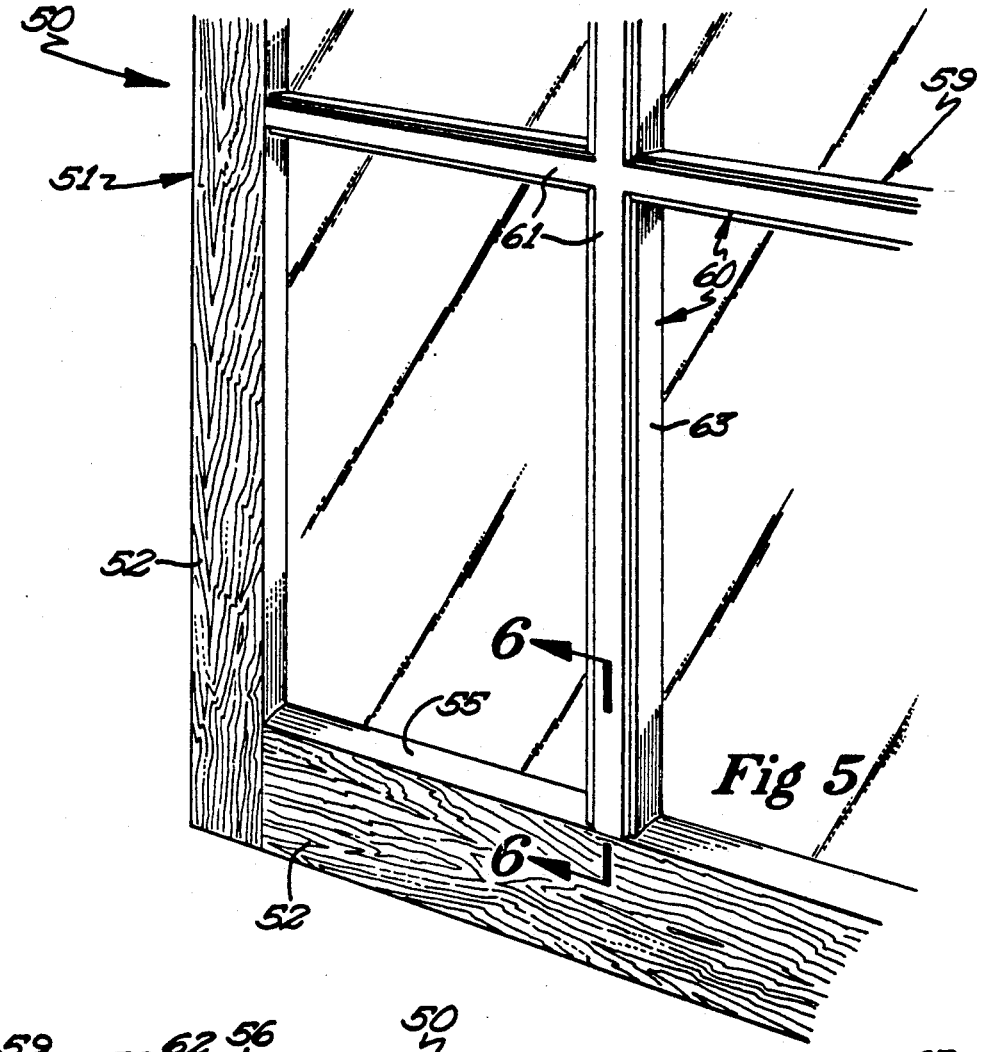
FIG. 5 is a perspective view of a window frame utilizing a different embodiment of the grill clip.

It will be noted that each grill bar 20 has a concave end surface 24 at each end thereof and also has a downwardly extending lip 25 at each end. Each end of the bar also has a recess 26 therein as best seen in FIG. 4. When the grill 19 is applied to a window, the concave end surfaces of each grill bar are disposed in contacting relation with respect to the convex surfaces of the window frame numbers 12.

Figure 2:
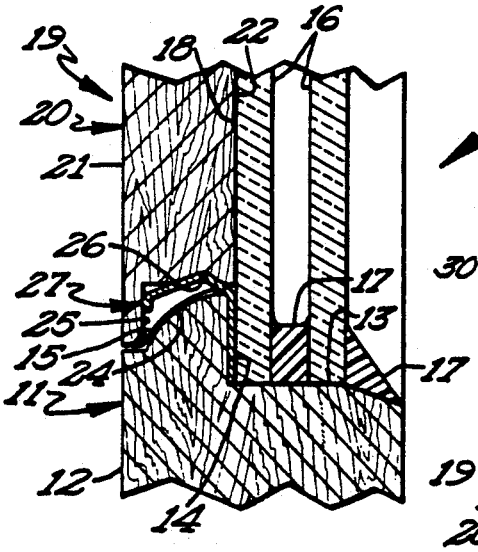
FIG. 2 is a cross-sectional view taken approximately along line 2—2 of FIG. 1 and looking in the direction of the arrows.
Figure 3:
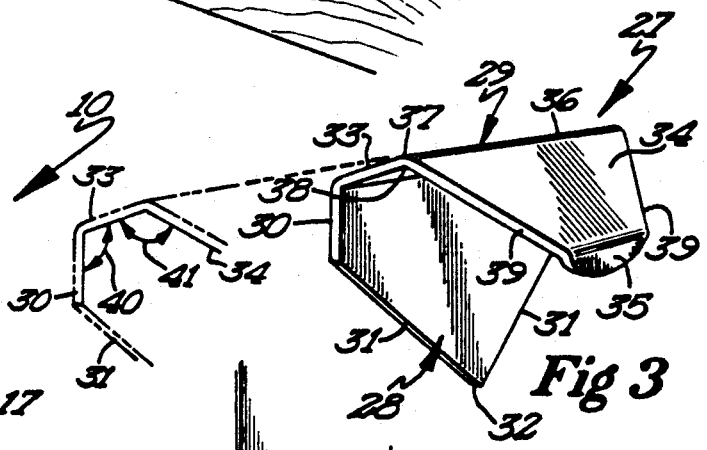
FIG. 3 is a perspective view of the novel grill clip.

Concealed spring clips are used to secure the grill 19 to the window frame members 12, and these clips, designated generally by the reference number 27, are illustrated in FIGS. 2 and 3. A plurality of clips will be used to secure a grill 19 to the associated window. It will be seen that clips 27 are of generally L-shaped configurations and are formed of spring metal. Each clip includes a substantial flat frame engaging leg 28 and a coupling leg 29 integral with the frame engaging leg and extending angularly therefrom. The frame engaging leg has straight parallel side edges 30 and converging edges 31 that converge to a pointed end 32.

The coupling leg 29 of each clip is of outwardly convex configuration and includes an outwardly extending portion 33 and an inwardly extending portion 34. The inwardly extending portion 34 is integral with a terminal lip 35 that extends angularly inwardly therefrom. The juncture between the outwardly extending portion 33 and the inwardly extending portion 34 comprises a fold line 36 which extends transversely across the coupling leg 29.

The outwardly extending portion and inwardly extending portion define an upwardly convex surface 37 and a inwardly facing concave surface 38. It will also be noted that the inwardly extending portion 34 of the coupling leg has side edges 39 that converge from the fold line 36 towards the terminal lip 35 which gives the inwardly extending portion a trapezoidal configuration. It will be noted that the inwardly extending portion 34 has a greater length dimension than the outwardly extending portion 33.

When the clips 27 are used to secure the grill to a window, each frame engaging leg 28 is forced between the inner surface 18 of the innermost pane 16 and the flat surface 14 of a window frame member. The pointed end 32 facilitates penetration of the frame engaging member into the glazing compound. A pair of clips 27 will be used to engage and secure opposite ends of a grill bar to opposite frame members.

In this regard, the outwardly convex surface of the coupling leg will engage in the recess 26 of the grill bar with a snap coupling spring effect. This securely locks the grill to the window so that the inner surface 22 of each grill bar engages the inner surface 18 of the pane. The clips are substantially concealed from the inside so that the grill appears to be secured to the frame 11 while engaging the inner surface of the innermost pane 16. The upward spring locking effect of the clip positively secures the grill to the window.

The spring effect which snap couples the clips to the grill device derives from the resiliency of the metal and the particular construction of the clip. It will be noted that the included angle 40 between the frame engaging leg 28 and the outwardly extending portion 33 is greater than 90 degrees. Similarly, the included angle 41 between the outwardly extending portion 33 and the inwardly extending portion 34 is greater than 90 degrees.

Referring now to FIGS. 5 through 8, it will be seen that a different embodiment of the clip is used to secure an ornamental grill to a window 50. The window 50 includes frame members 52 which are secured together and each including a flat surface 53 and a flat surface 54. Each frame member is also provided with a convex surface 55 along the inner side thereof. Transparent spaced apart panes 56 extend between and are secured to the frame members and a seal is formed therebetween by conventional glazing compound 57. A grill 59 is positioned against the inner surface 58 of the innermost pane 56 and is secured to the frame members by the embodiment of the grill clip particularly illustrated in FIG. 7.

Figure 6:
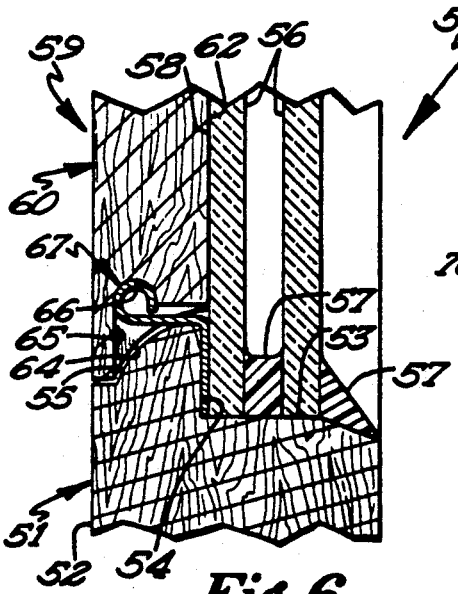
FIG. 6 is a cross-sectional view taken along approximately line 6—6 of FIG. 5 and looking in the direction of the arrows.
Figure 7:
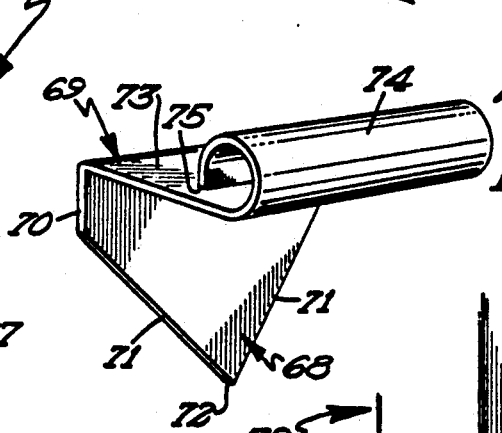
FIG. 7 is a perspective view similar to FIG. 3 illustrating the modified form of the grill clip and FIG. 8 is a fragmentary perspective view of an end portion of a grill bar illustrating details of construction thereof.
Figure 8:
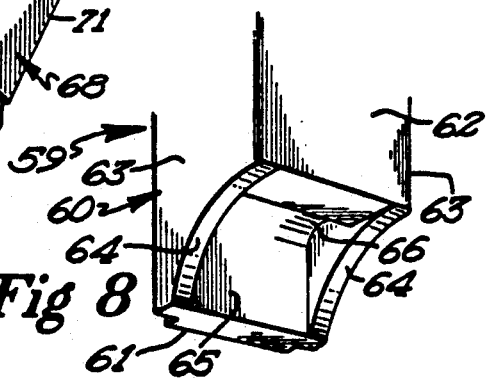

The grill 59 is similar to the embodiment of the grill illustrated in the embodiment of FIGS. 1–4 and is comprised of horizontal and vertical grill bars 60 secured together. Each grill bar 60 has an outer surface 61, a substantially flat inner surface 62 and side surfaces 63. When the grill 59 is applied to the frame 51, the flat inner surfaces of the grill bars engage the inner surface 58 of the pane. Referring now to FIGS. 6 and 7, it will be seen that each end of each grill bar 60 is concave as at 64. The concave end 64 is engagable with the convex surface 55 of the associated frame member 52. It will further be noted that each concave end 64 has a recess 66 therein and a lip 65 projecting longitudinally therefrom. In the embodiment of FIGS. 5 through 8, the recess 66 is of arcuate configuration.

Referring now to FIGS. 6 and 7, it will be seen that a different embodiment of the concealed clip, designated generally by the reference numeral 67 is thereshown. The clip 67 is of generally L-shaped configuration and includes a frame engaging leg 68 and a coupling leg 69. The frame engaging leg 68 is of flat configuration and has parallel side edges 70 and converging side edges 71, the latter converging to a pointed end 72.

The coupling leg 69 includes a flat portion 73 and a rolled portion 74. It will be noted that the flat portion 73 of the coupling leg is disposed in substantially right angular relation with respect to the frame engaging leg 68. The outer portion of the coupling leg is rolled into arcuate configuration to define the rolled portion 74. Specifically, the rolled portion extends first arcuately outwardly from the flat portion 73, then arcuately towards the frame engaging leg 68, thereafter inwardly towards the flat portion. The rolled portion 74 terminates in an edge 75 which is positioned above but adjacent the upper surface of the flat portion 73. It will be noted that the length dimension of the rolled portion 74 is only slightly less than the overall length dimension of the coupling leg.

In use, the frame engaging leg 68 will be urged between the pane 56 and the associated frame member 52 so that the point 72 penetrates the glazing compound. When the grill is applied to the window frame, the rolled portion 74 will snap into the recess 66 in the end of the associated grill bar to lock the grill bar in place. The upwardly resilient spring action of the coupling leg, produces a snap coupling effect which very effectively locks the grill to the frame and against the inner surface of the innermost pane. It is again pointed out that the clips are concealed when viewed from the inside thereby imparting the effect that the grill is an integral part of the window.

In both of the embodiments shown, the outwardly convex configuration of the coupling leg imparts the snap coupling spring characteristic of the grill clip. Further, the grill clips are completely concealed from the inside and are substantially concealed from the outside to thereby improve the aesthetic appearance of the window.

Thus it will be seen that I have provided a novel and improved grill clip which serves to effectively secure a grill to a window or door frame.

What is claimed is:

1. In combination with a window including a generally rectangular-shaped frame having a generally convex inner frame surface portion, a glass pane mounted in the frame and having inner and outer surfaces, a grill comprised of a plurality of grill bars interconnected with each other in right angular relation, each grill bar having an outer surface and an inner surface, said outer surface engaging the inner surface of the glass pane, each grill bar having concave end surfaces contoured to mate with the convex inner frame surface portion of the frame, each concave end surface of each grill bar having an arcuate recess therein spaced from the inner surface of the grill bar, a plurality of identical one-piece grill engaging clips formed of spring metal, each clip including a substantially flat frame-engaging leg having one end thereof pointed and being inserted between the frame and the glass pane, each clip including a coupling leg integral with the frame-engaging leg and presenting an outwardly convex angular outer surface, said coupling leg including a substantially flat first portion integral with the frame-engaging leg and extending angularly therefrom, a substantially flat second portion integral with said first portion and extending angularly therefrom, a transverse fold line between said first and second portions defining the apex of said outwardly convex outer surface, said coupling leg engaging in the angular recess of the grill bar with snap coupling spring effect to thereby secure the grill to the frame and against the inner surface of said pane.

2. The invention as defined in claim 1 wherein the included angle between the frame-engaging leg and said first portion being greater than 90°.

3. The invention as defined in claim 2 wherein the included angle between the first and second portions of said coupling leg is greater than 90°.

4. The invention as defined in claim 1 wherein said second portion is of trapezoidal configuration and has a length dimension greater than the length dimension of said first portion.

5. The invention as defined in claim 4 and a lip integral with said second portion and extending angularly inwardly therefrom.

6. In combination with a window including a generally rectangular-shaped frame having a generally convex inner frame surface portion, a glass window pane mounted in the frame and having inner and outer surfaces, a grill comprised of a plurality of grill bars interconnected with each other in right angular relation, each bar grill having an outer surface and an inner surface, said outer surface engaging the inner surface of the glass pane, each grill bar having concave end surfaces contoured to mate with the convex inner frame surface portion of the frame, each concave end surface of each grill bar having an arcuate recess therein spaced from the inner surface of the grill bar, a plurality of identical one-piece grill engaging clips formed of spring metal, each clip including a substantially flat frame engaging leg having one end thereof pointed and being insertable between the frame and glass pane, each clip including a coupling leg integral with said frame engaging leg and extending angularly therefrom, said coupling leg including a flat portion integral with said frame engaging leg and extending in substantially right angular relation from the frame engaging leg, a rolled portion integral with said flat portion and extending first arcuately outwardly, then arcuately towards the frame engaging leg and thereafter extending arcuately inwardly, said coupling leg engaging in the arcuate recess in the grill bar with snap coupling spring effect to secure the grill against the frame and against the inner surface of the pane.

7. The invention as defined in claim 6 wherein said rolled portion of said coupling leg has an edge positioned above but adjacent the outer surface of the flat portion of said coupling leg.

* * * * *